US006990788B2

(12) United States Patent
Peterse et al.

(10) Patent No.: US 6,990,788 B2
(45) Date of Patent: Jan. 31, 2006

(54) AIR BLADDER PACKING SYSTEM AND PROCESS FOR USING THE SAME

(75) Inventors: Joop Peterse, Beugen (NL); Eric van Melick, Heythuysen (NL); Raymond van den Hengel, Venlo (NL)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/980,351

(22) Filed: Nov. 3, 2004

(65) Prior Publication Data

US 2005/0109657 A1 May 26, 2005

Related U.S. Application Data

(62) Division of application No. 10/721,846, filed on Nov. 25, 2003, now abandoned.

(51) Int. Cl.
*B65B 23/00* (2006.01)

(52) U.S. Cl. ..... 53/472

(58) Field of Classification Search ..... 53/472; 206/522; 383/3; 446/220
See application file for complete search history.

(56) References Cited

U.S. PATENT DOCUMENTS 3,389,501 A * 6/1968 Arizona ..... 49/386
3,398,501 A * 8/1968 Aninger ..... 53/474
3,742,994 A * 7/1973 Pensak ..... 383/3
3,889,743 A * 6/1975 Presnick ..... 165/46
4,179,832 A * 12/1979 Lemelson ..... 40/540
4,486,975 A * 12/1984 Harreld et al. ..... 446/220
4,969,312 A * 11/1990 Pivert et al. ..... 53/472
5,022,217 A * 6/1991 Vilas Boas et al. ..... 53/472
5,706,969 A * 1/1998 Yamada et al. ..... 220/592.2
5,762,198 A * 6/1998 Hung ..... 206/522
5,769,232 A * 6/1998 Cash et al. ..... 206/522
5,769,531 A * 6/1998 Hunt et al. ..... 362/233
5,845,806 A * 12/1998 Parchman ..... 220/739
6,123,217 A * 9/2000 Miller ..... 220/592.19
6,341,475 B2 * 1/2002 Weder ..... 534/472
6,398,029 B1 * 6/2002 Farison et al. ..... 206/522

* cited by examiner

*Primary Examiner*—John Sipos
(74) *Attorney, Agent, or Firm*—Oliff & Berridge, PLC; Eugene Palazzo

(57) ABSTRACT

An air bladder packing system having an inflatable center body and extensions therefrom. The center body is generally for placement on top of an item placed in an outside box while the fingers are designed for positioning in the spaces between the item and the walls of the box. After placement, the air bladder is inflated to span the space between the item and the box, thereby securely holding the item in the box and providing protection against shifting during transport and providing impact protection.

18 Claims, 3 Drawing Sheets

AIR BLADDER PACKING SYSTEM AND PROCESS FOR USING THE SAME

CROSS-REFERENCE TO RELATED APPLICATIONS

This is a divisional of U.S. application Ser. No. 10/721,846 filed Nov. 25, 2003 now abandoned by the same inventors, and claims priority therefrom. This divisional application is being filed in response to a restriction requirement in that prior application and contains rewritten and/or additional claims to the restricted subject matter.

BACKGROUND AND SUMMARY

Most consumer equipment, especially electronics, and much commercial equipment comes carefully packaged in rigid foam or other sturdy and form-fitting packaging material designed to cushion and hold the equipment firmly within an outer box. Where the equipment is mass produced and automatically packaged, custom-formed packing inserts are the norm. Where economies of scale cannot justify the costs of design, tooling, and production of specialized inserts, other packing materials are desired. The desire for a flexible and inexpensive packing material is particularly relevant to the repair and reconditioning industry. In particular, substantially sized equipment such as printers, television sets, and similar bulky items.

In addition to custom-fitting inserts, so-called packing "peanuts" or "shells" are sometimes used. Such loose packing typically comprises foam or cellulose pellets that are poured around equipment once placed in the outer box. Drawbacks include the shifting of the pellets during handling of the box and the danger of small particles or fibers separating from the pellets and infiltrating the equipment. Even when the equipment is wrapped in plastic, the tiny fibers and particles from pellets are messy and can infiltrate the equipment during unpacking.

For small to medium size items, a series of airbags are offered as packing material by companies such as Polyair Inter Pack, Inc. Polyair's Airspace Pillow Packaging System™ is typical in comprising a series of rectangular airbags of thin plastic that are initially held together along perforated edges. When packing equipment or small items, the requisite number of airbags are tom off and packed around the shipped items. Among disadvantages are the inability to tightly pack bulky items both because the airbags are made of easily broken thin membranes and because it is difficult to tightly pack airbags that are already inflated. This disadvantage is particularly likely to occur near the lower portions of outer boxes since fingers and hands become blocked by the airbags themselves. A product brochure with pictorial and text explanations are found at www.polyair.com.

It would be desirable to have inexpensive, flexible, non-contaminating and easily installed inner packaging material.

One embodiment of the invention is an air bladder packaging system for packing an item having sides in an outer box having walls wherein a space exists between a side and a wall, such packaging system comprising: an inflatable center body for placement proximate to one surface of the item; a plurality of inflatable fingers attached to the center body and having a length, at least a portion of the length being designed for placement along a side of the item in the space between the side and a wall of the outer box; and a valve through which compressed gas may be inserted into the air bladder; wherein, once sufficient gas is inserted, a portion of the finger spans the space between the side of the item and the wall of the box.

Another embodiment of the invention is a process for packing an item having sides in an outer box having walls, comprising: placing a center body of an air bladder proximate to a surface of the item; positioning at least a portion of a finger of the air bladder along a side of the item in the space between the side and a wall of the outer box; and inflating the finger sufficiently to span the space between the side and the wall.

DETAILED DESCRIPTION

Figure 1:
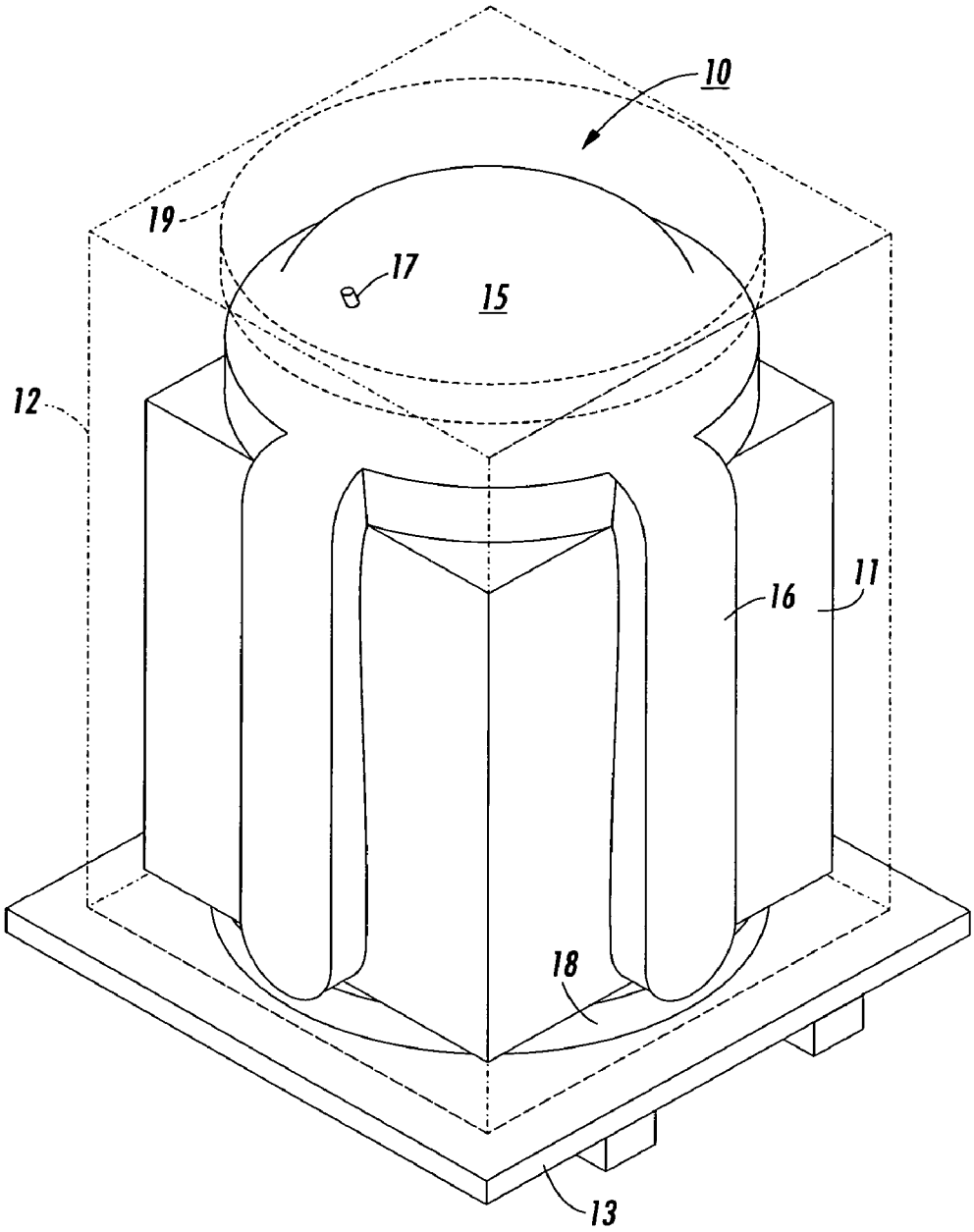
FIG. 1 is an elevated perspective view of one embodiment of the invention used in packing an item in an outer box.

For a general understanding of the present invention, reference is made to the drawings. In the drawings, like reference numerals have been used throughout to designate identical elements.

Referring first to FIG. 1, a bulky item 11 such as a printer or television set is shown packaged in an outer box 12. Box 12 is shown placed on pallet 13. Inner packing is formed by air bladder 10. Air bladder 10, in this embodiment, is composed of a round central body 15, a series of fingers 16, and a valve 17 through which air may be inserted and removed. Air bladder 10 is inserted into box 12 on top of item 11 while air bladder 10 is either uninflated or slightly inflated. Once wrapped over and around item 11, air bladder 10 is inflated sufficiently such that fingers 16 snugly span the space between the sides of item 11 and outer box 12. In the event that central body 15 does not inflate to fill the entire height of box 12, then additional packing material 19 such as an additional air bladder or other simple packing material can be added to firmly span the height. As shown in FIG. 1, item 11 will generally be packed with bottom packing material 18 to cushion the bottom of item 11.

Figure 2:
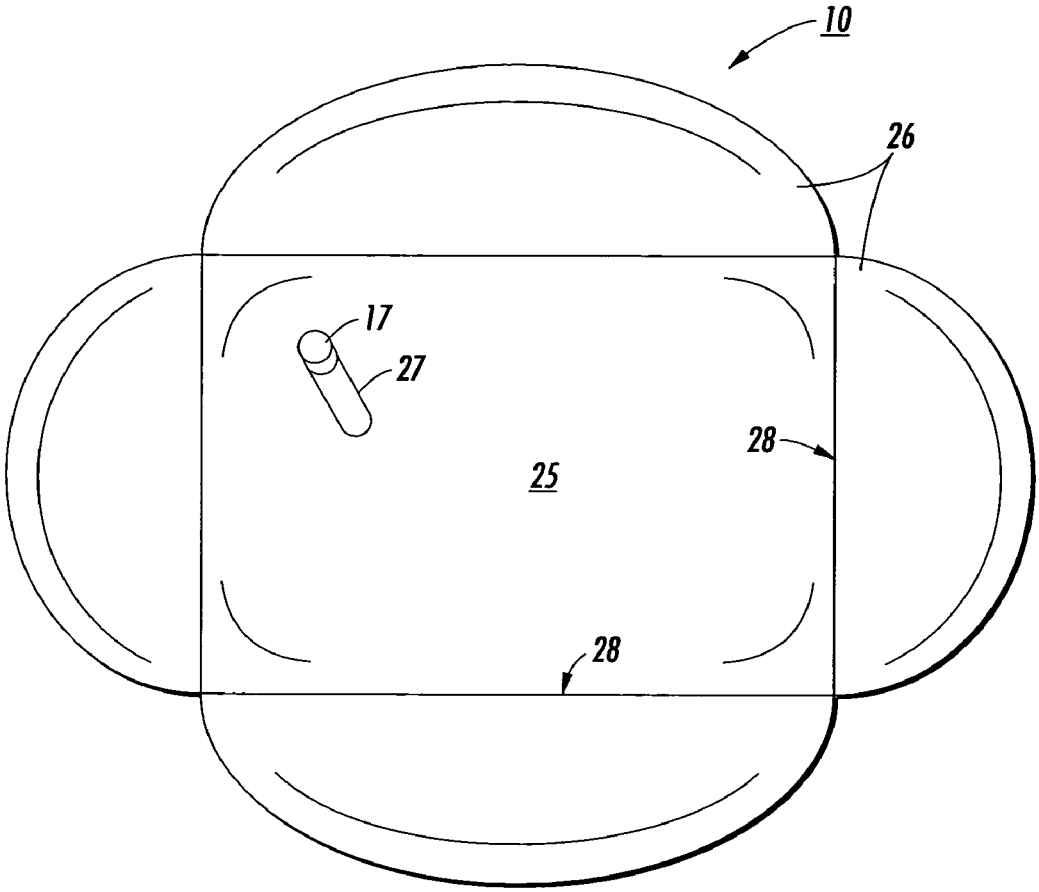
FIG. 2 is an elevated orthogonal view of another embodiment of the invention in an uninflated condition.

Referring to FIG. 2, another embodiment of air bladder 10 is shown prior to insertion and inflation. In contrast to a round central body 15 as shown in FIG. 1, center body 25 is rectangular and is suitable to fill the cross-sectional area of a rectangular box. As will be understood, central body 25 can be round, square, rectangular, elliptical, triangular, star-shaped, or any other regular or irregular shape. The central body may also simply comprise the junction of tubular appendages like fingers 16 of FIG. 1.

Fingers may also take any number of shapes and sizes. In FIG. 1, fingers 16 are long tubes that can extend down the entire side of box 12. In FIG. 2, fingers 26 are essentially semicircles or other arc shaped appendages attached to central body 25. Such a configuration may be preferred for comparatively short and wide outer boxes. Also shown in FIG. 2 is a fill tube 27 topped with a valve 17. Such a fill tube allows easier inflation by permitting the user to pull and maneuver the valve to more positions of choice. The seams 28 between fingers 26 and center body 25 are ideal locations to fold or bend fingers from the plane of the center body to the angles necessary to slip between the packed item 11 and outer box 12. These seams may be completely formed between the intersection of fingers and the center body or may be partially formed in order to permit gas to flow from one chamber to the next.

Figure 3:
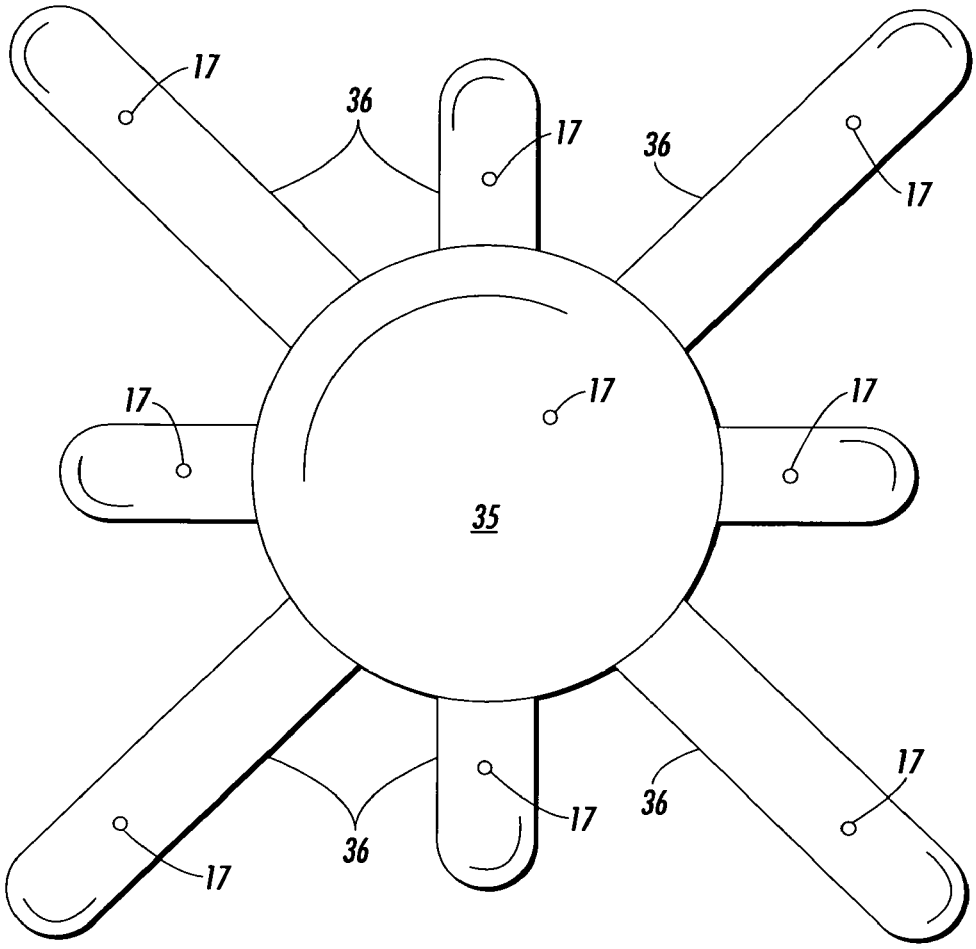
FIG. 3 is an elevated orthogonal view of another embodiment of the invention in an uninflated condition.

FIG. 3 shows a round central body 35 with eight fingers 36. Any number of fingers are feasible, and the more fingers 36, the more that air bladder 10 can accommodate irregular shapes by draping various fingers over recessed areas of item 11. Fingers 36 may also be of varying length, as shown in FIG. 3. Such varying length may be preferred in order to diminish the amount of compressed air that must be inserted into air bladder 10 for proper inflation. Each finger may have its own air valve or, more commonly, one valve 17 will be located on the central body, on any of the fingers, or on a filling tube that can be manipulated for easy attachment of an air hose or other means of inserting gas. In the event that only one valve 17 is present, then the central body and each of the fingers will have a communicable passage allowing air in one chamber to pass into adjoining chambers until all have filled with gas.

It is expected that air bladder 10 can be made of either thin film plastic for throw-away bags or made of heavier and more durable plastic for airbladders intended to be reused. Polyethylene, polypropylene, and PVC are among the large number of plastic resins suitable for use as the film material comprising air bladder 10. Virtually any flexible plastic film material that is airtight can be used, especially if it is thermoplastic in order to make heat-sealing of seams possible. For environmental benefits, air bladder 10 may be made of bio-degradable plastics and accordingly offer environmental advantages over existing packing materials such as non-degradable rigid foam. In addition, air bladders of the present invention occupy less volume when uninflated and are accordingly easier to ship and store.

The air bladder packing system described above is ideal for use whenever packing material customized for a bulky or heavy item is not available. Such lack of customized packing material often occurs when equipment is being picked up remotely from its manufacturing facility for repairs or reconditioning. Uninflated air bladders are ideal for providing drivers of trucks or other vehicles an inexpensive system for safely packing items of unpredictable size and shape. Lack of customized packing materials also often occurs when preparing to ship used equipment, including reconditioned equipment, for resale or other use, and for repaired items being returned. When dealing with non-factory items, it is often too expensive to inventory customized packing for many different items, and the flexibility of an air bladder system should considerably reduce inventory cost and space.

Although air bladder 10 may be inflated prior to insertion into box 12, it is anticipated that in most instances, a valve such as valve 17 will be provided in order that air bladder 10 be inserted while uninflated or only partially inflated. One possible process for packing an item 11 such as a printer into a box 12 comprises: Prior to placing item 11 into the box, an air bladder of the present invention or other suitable packing material is placed into box 12 at the location on which item 11 is to be placed. If an air bladder is used, it may be at least partially inflated before item 11 is lowered into the box or it may initially remain uninflated. Item 11 is then placed into box 12 by usual handling techniques. Such techniques may comprise, without limitation, placing item 11 onto unfolded box 12 and then forming box 12 around item 11 by folding the sides upward. Similarly, the base of box 12 may be separate from the sides and top of box 12, and after item 11 is placed on the base, the sides and top of box 12 are dropped over item 11 and fastened to the base member. In the normal course, box 12 will be pre-assembled and opened on the top. Item 11 will be manually or otherwise gripped, raised over the open end of box 12, and lowered into the box. Next, packers place an uninflated or partially inflated air bladder of the present invention on item 11 and generally center its central body over item 11. The appendages, or fingers, of air bladder 10 will then be draped over the sides of item 11 and inside outer box 12. If the fingers are sufficiently uninflated, then they may be simply lowered, or dropped in the space between item 11 and box 12. If simple lowering is not sufficient, than a packer's hand or simple tool can push and manually brush the fingers until they fully extend toward the bottom of box 12. Air bladder 10 is then inflated by coupling valve 17 to a pressurized air hose until each of the fingers have expanded sufficiently to press and hold item 11 snugly against the sides of box 12. In the event that an air bladder of the present invention was placed underneath item 11 prior to its placement into box 12, then the bottom air bladder will be pressurized. This may be done immediately after item 11 is placed in box 12 or after the "top" air bladder has been placed and filled. The valve for the bottom air bladder may be reachable either because it is near the tip of one of its fingers which were lifted above the bottom of the box or because the box is turned over, and access to the valve was obtained through the end of the box proximate to the "bottom" airbladder. In the event that there is extra space between the top of the air bladder center body and the top lid or enclosure member of box 12, then additional packing material can be added, including another air bladder if desired. Once delivered, removal of the air bladder is simplified by simply opening the air valve. The air bladder can then deflate and be ready for reuse.

In review, the inflatable air bladder of the present invention includes a center body, fingers, and an air valve and is designed to be inflated around an item to be shipped, thereby providing inexpensive, flexible, and reliable packing protection. When compared to non-custom packing materials in the prior art, the present invention is less contaminating, easier to install, easier to reuse, less likely to shift during transit, and more robust than other air-filled packaging.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A process for packing an item having sides in an outer box having walls wherein a space exists between at least one of the sides and at least one of the walls, comprising:

placing a center body of an air bladder proximate to a first side of the item;

positioning at least a portion of at least one finger of the air bladder along one of the sides of the item in the space between the one side and one of the walls of the outer box, wherein a width of the at least one finger is less then a width of the center body, and the at least one finger is continuous so as not to include an aperture therein; and inflating the at least one finger sufficiently to span the space between the one side and the one of the walls, and, once inflated, the at least one finger does not span a space between another one of the walls of the box and another one of the sides of the item, the another one side of the item being opposite to the first side.

2. The process of claim 1, wherein inflating further comprises inserting compressed gas in a valve located on the center body.

3. The process of claim 1, wherein inflating further comprises inserting compressed gas through a plurality of valves.

4. The process of claim 1, further comprising releasing compressed gas from the air bladder during unpacking of the item.

5. The process of claim 1, further comprising reusing the air bladder to pack a second item.

6. The process of claim 1, wherein positioning further comprises using a tool to fully extend the at least one finger away from the center body.

7. The process of claim 1, further comprising placing additional packing material to fill a space between the air bladder and the one of the walls of the box.

8. The process of claim 1, further comprising placing additional packing material in the space between the one of the walls of the box and the another one of the sides of the item.

9. The process of claim 1, further comprising inflating at least one finger and the center body.

10. The process of claim 1, wherein the item being packed is an electrophotographic printer.

11. The process of claim 1, further comprising carrying the air bladder on a vehicle to enable packing of the item remotely from manufacturing facilities.

12. The process of claim 1, further comprising selecting a used item for packing.

13. The process of claim 1, wherein inflating further comprises connecting a source of compressed gas to a valve located on the at least one finger.

14. The process of claim 13, wherein the valve is located on a filling tube.

15. The process of claim 1, wherein the at least one finger is essentially tubular shaped.

16. The process of claim 1, wherein the air bladder has a plurality of fingers.

17. The process of claim 16, wherein the air bladder has four fingers.

18. The process of claim 16, wherein the air bladder has more than four fingers.

* * * * *